US010843492B2

(12) United States Patent
Nihashi

(10) Patent No.: US 10,843,492 B2
(45) Date of Patent: Nov. 24, 2020

(54) MAGNETIC-INK READING DEVICE AND PRINTER

(71) Applicant: TOSHIBA TEC KABUSHIKI KAISHA, Tokyo (JP)

(72) Inventor: Kiyotaka Nihashi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 39 days.

(21) Appl. No.: 16/205,878

(22) Filed: Nov. 30, 2018

(65) Prior Publication Data

US 2019/0176496 A1 Jun. 13, 2019

(30) Foreign Application Priority Data

Dec. 8, 2017 (JP) ..... 2017-236390

(51) Int. Cl.
*G07F 19/00* (2006.01)
*B41J 13/00* (2006.01)
(Continued)

(52) U.S. Cl.
CPC ..... *B41J 13/0045* (2013.01); *B41J 2/04558* (2013.01); *B41J 2/04586* (2013.01);
(Continued)

(58) Field of Classification Search
CPC ..... B41J 13/0045; B41J 2/04558; B41J 2/04586; B65H 5/26; B65H 85/00; B65H 2301/5131; B65H 2701/1912
(Continued)

(56) References Cited

U.S. PATENT DOCUMENTS 5,422,467 A * 6/1995 Graef ..... B65H 29/58 235/379
5,438,186 A * 8/1995 Nair ..... G06Q 20/04 235/379
(Continued)

FOREIGN PATENT DOCUMENTS

EP 2 481 598 A1 8/2012
JP H09-142708 A 6/1997

OTHER PUBLICATIONS

Search Report dated May 7, 2019 received in corresponding European Application No. 18 21 0358.0, 8 pages.
(Continued)

*Primary Examiner* — Karl D Frech
(74) *Attorney, Agent, or Firm* — Foley & Lardner LLP

(57) ABSTRACT

A magnetic-ink reading device includes a housing and a conveyor in the housing. A medium inlet and outlet port for inserting and pulling out a medium printed using magnetic ink are in the housing. The conveyor conveys the medium along a conveying path. The magnetic-ink reading device includes a magnetizing mechanism configured to magnetize the magnetic ink of the medium on the conveying path and a magnetism detection head disposed near the magnetizing mechanism and configured to read magnetism of the magnetized magnetic ink. The magnetic-ink reading device includes a reversing mechanism provided on the medium inlet and outlet port side of the conveying path and configured to reverse front and rear surfaces of the medium on a reversing path on an inside. The reversing mechanism includes a retraction path for temporarily retracting the medium when the magnetism of the medium is read by the magnetism detection head.

19 Claims, 6 Drawing Sheets

(51) Int. Cl.
*B41J 2/045* (2006.01)
*B65H 85/00* (2006.01)
*B65H 5/26* (2006.01)

(52) U.S. Cl.
CPC ..... *B65H 5/26* (2013.01); *B65H 85/00* (2013.01); *B65H 2301/5131* (2013.01); *B65H 2701/1912* (2013.01)

(58) Field of Classification Search
USPC ..... 235/379, 475, 477, 480
See application file for complete search history.

(56) References Cited

U.S. PATENT DOCUMENTS

| | | | |
|---|---|---|---|
| 6,257,783 | B1 | 7/2001 | Hanaoka et al. |
| 7,443,525 | B2 | 10/2008 | Takiguchi |
| 2010/0295232 | A1 | 11/2010 | Spall et al. |

OTHER PUBLICATIONS

Office Action issued in corresponding Chinese Patent Application No. 201811489053.9 dated Dec. 26, 2019, with translation, ten (10) pages.

* cited by examiner

MAGNETIC-INK READING DEVICE AND PRINTER

CROSS-REFERENCE TO RELATED APPLICATION

This application is based upon and claims the benefit of priority from Japanese Patent Application No. 2017-236390, filed in Dec. 8, 2017, the entire contents of which are incorporated herein by reference.

FIELD

Embodiments described herein relate generally to a magnetic-ink reading device and a printer.

BACKGROUND

A printer apparatus used as an issuing apparatus for a receipt or a ticket prints a sheet-like medium (recording paper) and discharges the medium. In such a printer apparatus, a part of the medium sometimes protrudes from an inlet and outlet port of an apparatus housing during the printing. Therefore, a user sometimes grabs or pulls out the medium by mistake. This sometimes causes a breakdown of a conveying mechanism or a paper jam. In such an apparatus, a retraction path is separately provided in the apparatus to prevent the medium from being exposed to the user side. In general, for a reduction of the size of the apparatus, the retraction path is designed at a small curvature.

Characters (MICR characters; Magnetic Ink character recognition) are sometimes printed on the surface of a medium such as a check or a bill of exchange with magnetic ink. Such MICR characters are read by a magnetic-ink reading device as explained below. If the user inserts the check or the like into the apparatus from the inlet and outlet port, the MICR characters are magnetized by a magnet. Subsequently, a residual magnetic field generated by residual magnetism of the MICR characters is detected by a MICR head (a magnetism detection head). The MICR characters are identified from a magnetic characteristic and a magnetic pattern of the residual magnetic field. It is possible to discriminate the check or the like with the MICR characters.

Such a magnetic-ink reading device is incorporated and used in printers of an ATM and a POS. Such a magnetic-ink reading device magnetizes the MICR characters and detects the residual magnetic field to perform reading and printing. Even if such a device is provided, it is likely that the user grabs or pulls out the check or the like exposed from the inlet and outlet port during the reading or during the printing and the check or the like is made unusable.

On the other hand, if the check or the like is temporarily retracted to the retraction path having the small curvature during the reading or during the printing, a deficiency is sometimes caused during the reading or during the printing. Therefore, there is a demand for an apparatus capable of performing appropriate reading and printing according to various situations.

Related art is described in, for example, JP-A-09-142708.

DETAILED DESCRIPTION

An object is to provide a magnetic-ink reading device and a printer that can prevent, when magnetic ink printed on a medium is read and processed, the medium from being pulled out by a user by mistake and can be simplified in structure and reduced in size.

A magnetic-ink reading device according to at least one embodiment includes a housing and a conveying mechanism provided in the housing. A medium inlet and outlet port for inserting and pulling out a medium printed using magnetic ink is provided in the housing. The conveying mechanism (conveyor) conveys the medium along a conveying path. The magnetic-ink reading device includes a magnetizing mechanism configured to magnetize the magnetic ink of the medium on the conveying path and a magnetism detection head disposed near the magnetizing mechanism along the conveying path and configured to read magnetism of the magnetized magnetic ink. The magnetic-ink reading device further includes a reversing mechanism provided on the medium inlet and outlet port side of the conveying path and configured to reverse front and rear surfaces of the medium on a reversing path on an inside. The reversing mechanism includes a retraction path for temporarily retracting the medium when the magnetism of the medium is read in the magnetism detection head.

At least one embodiment is explained below with reference to the drawings.

Figure 1:
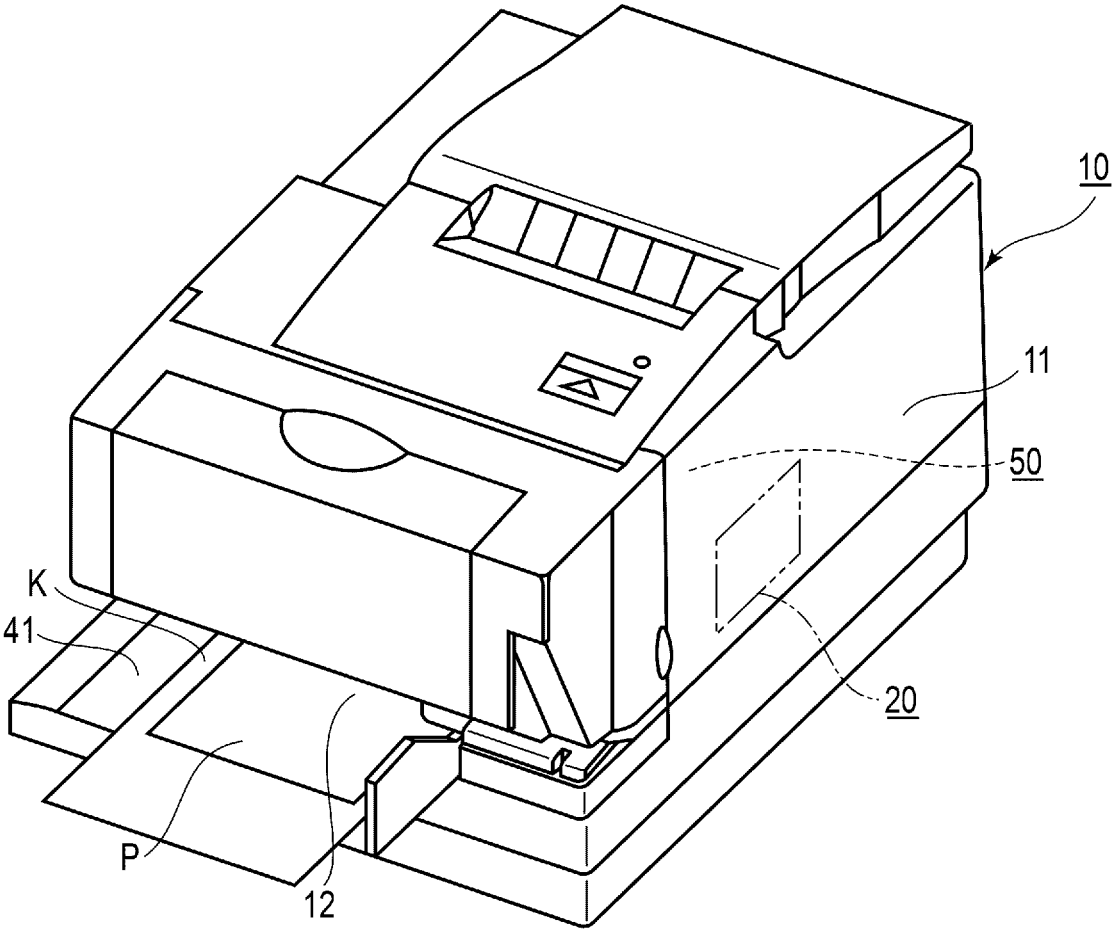
FIG. 1 is an exterior perspective view illustrating a printer incorporating a magnetic-ink reading device according to at least one embodiment.
Figure 2:
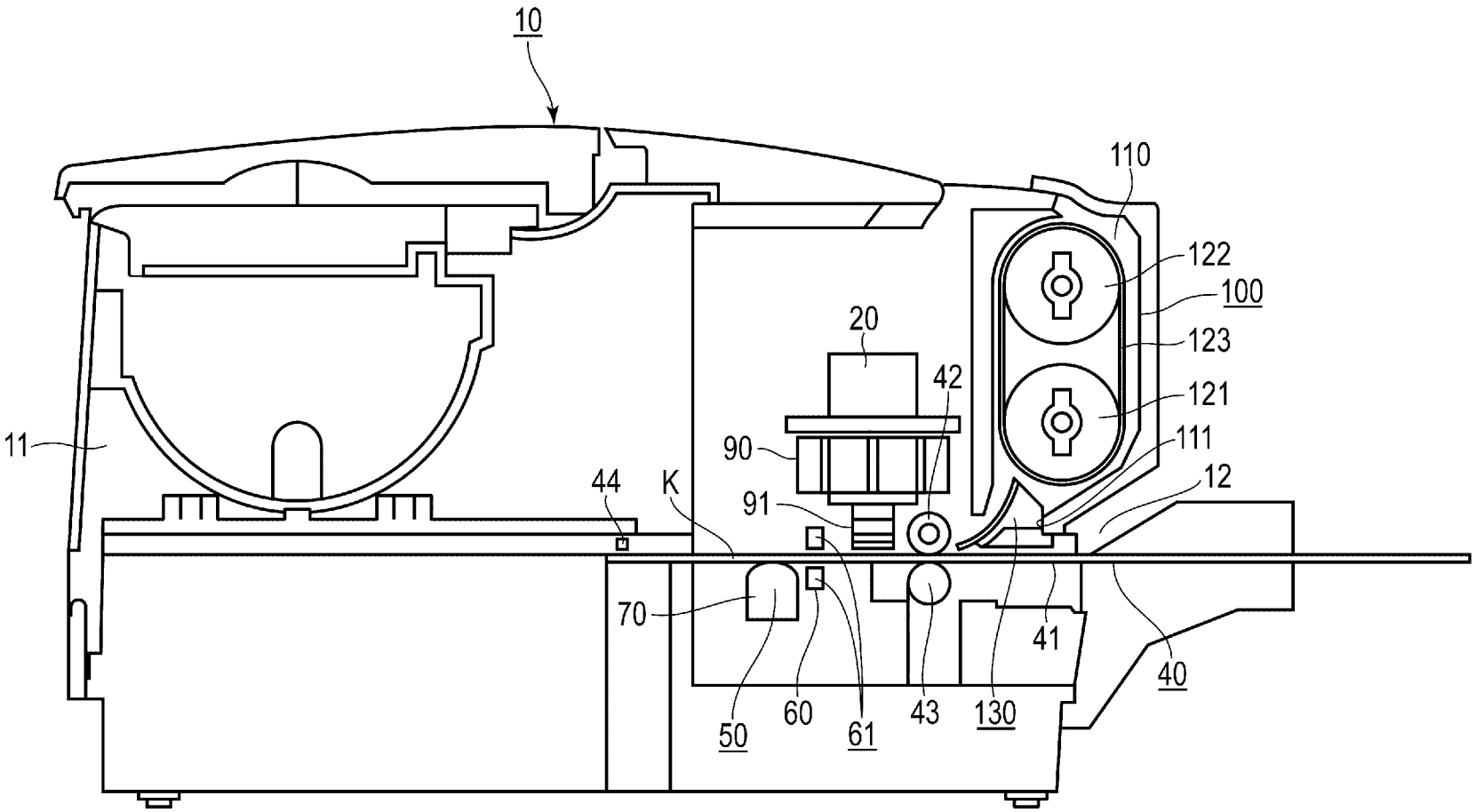
FIG. 2 is a longitudinal sectional view illustrating a schematic configuration of the printer.
Figure 3:
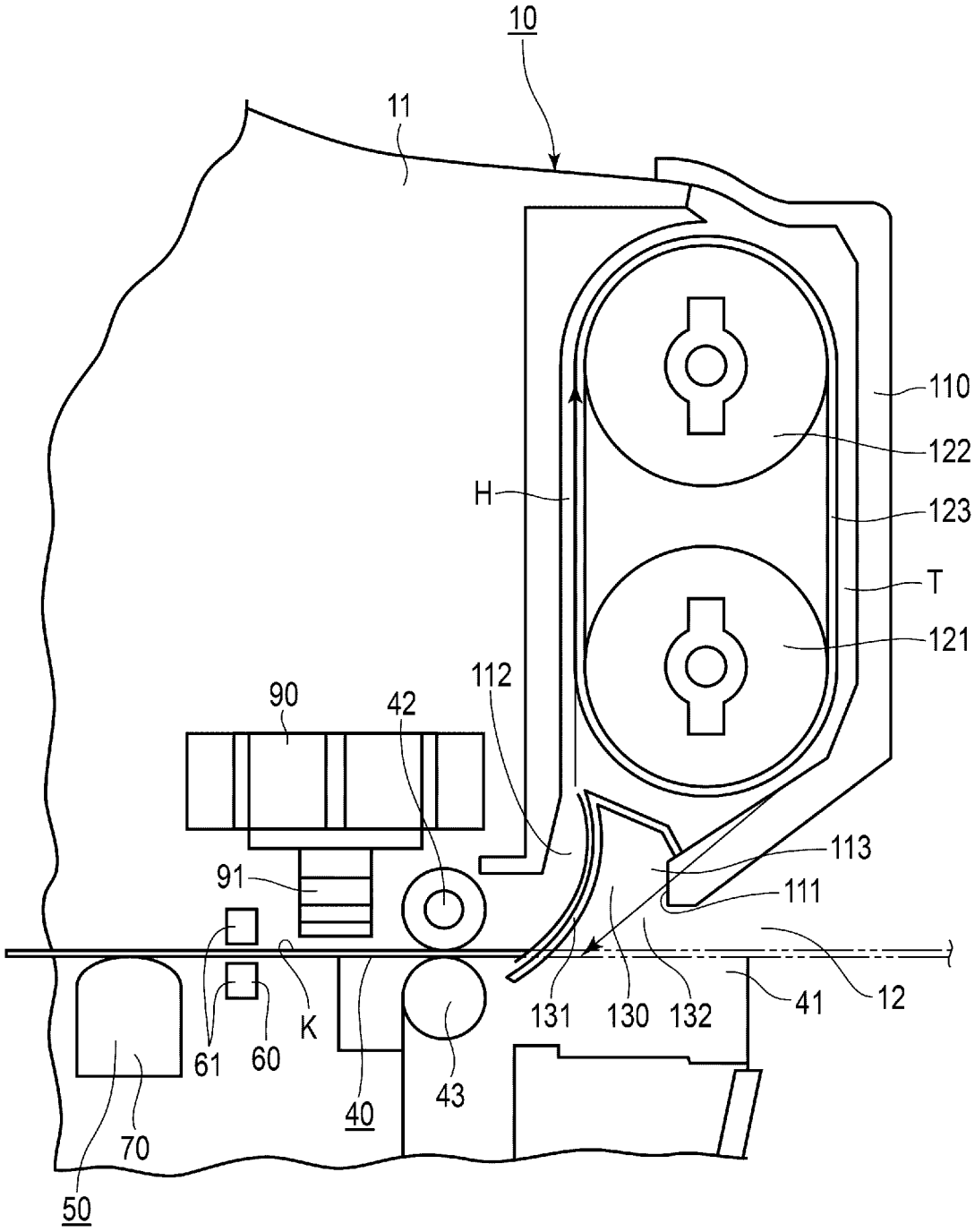
FIG. 3 is a longitudinal sectional view illustrating a main part of the printer.
Figure 4:
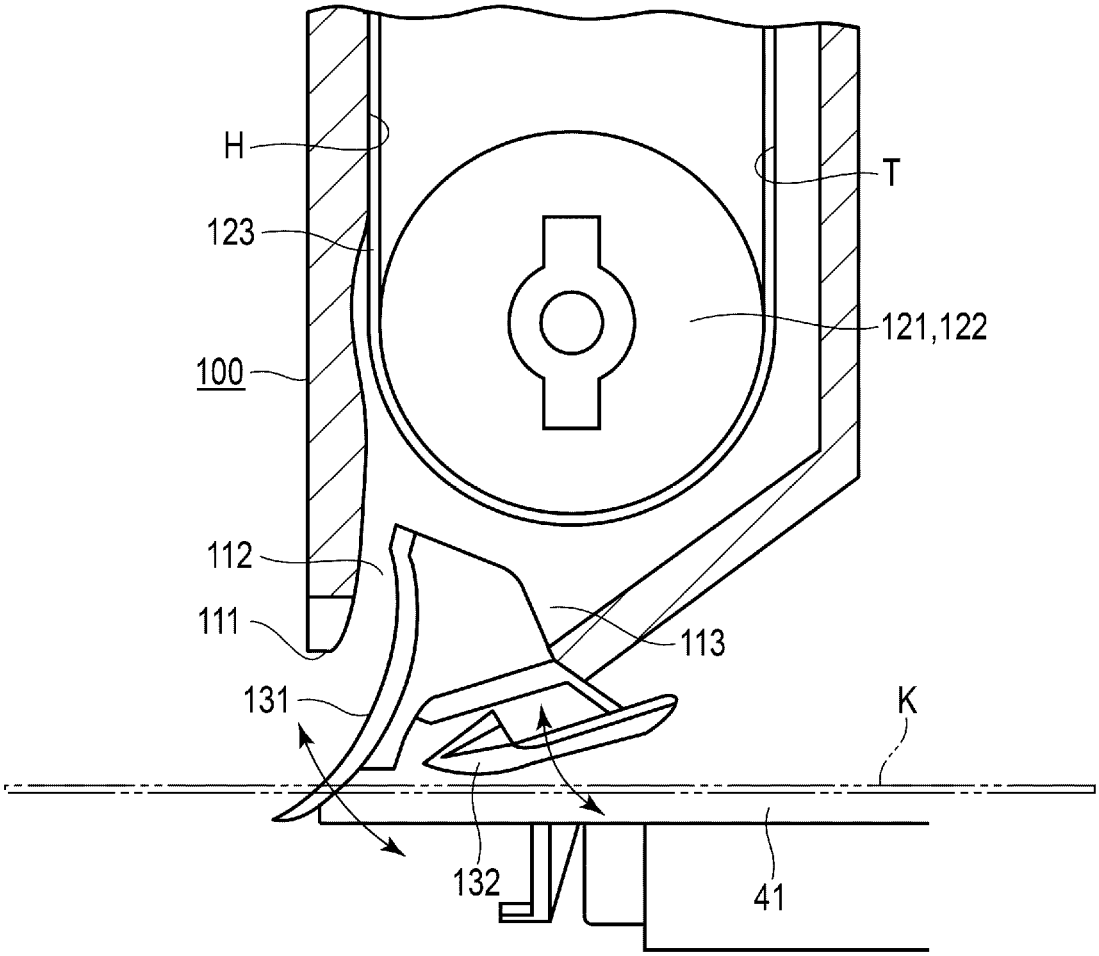
FIG. 4 is a longitudinal sectional view illustrating main parts of a conveying path and a reversing mechanism incorporated in the printer.

FIG. 1 is an exterior perspective view illustrating a printer 10 incorporating a magnetic-ink reading device 50 according to at least one embodiment. FIG. 2 is a longitudinal sectional view illustrating a schematic configuration of the printer 10. FIG. 3 is a longitudinal sectional view illustrating the magnetic-ink reading device 50 incorporated in the printer 10. FIG. 4 is a longitudinal sectional view illustrating main parts of a conveying path K and a reversing mechanism 100 incorporated in the printer 10.

The printer 10 is incorporated in an ATM of a bank or the like or a POS (Point Of Sales) terminal of a store, a warehouse, or the like. P in FIG. 1 indicates a check (a sheet-like medium) and K in the figure indicates a conveying path for the check P. Characters by normal ink and MICR characters by magnetic ink are respectively printed on the check P.

The printer 10 includes a housing 11. The conveying path K is formed in the housing 11. A medium inlet and outlet port 12 for inserting and discharging the check P from the outside is provided at the right end in FIG. 2 of the conveying path K. In the printer 10, the check P is inserted from the medium inlet and outlet port 12 with a surface printed with the magnetic ink in advance directed downward in FIG. 1.

As illustrated in FIG. 2, a control section 20, a conveying mechanism 40, a magnetic-ink reading device 50, a printing mechanism 90, and a reversing mechanism 100 are housed in the housing 11. The printing mechanism 90 is provided further on the medium inlet and outlet port 12 side than the magnetic-ink reading device 50. The reversing mechanism 100 is provided further on the medium inlet and outlet port 12 side than the printing mechanism 90. The control section 20 has a function of cooperatively controlling the conveying mechanism 40, the magnetic-ink reading device 50, the printing mechanism 90, the reversing mechanism 100, and the like.

The conveying mechanism 40 includes a table 41 on which the sheet-like check P is conveyed in the left-right direction in FIG. 2. A direction along the upper surface of the table 41 is a conveying direction K. The conveying mechanism 40 includes, along the table 41, a plurality of rollers including a feed roller 42 and a pinch roller 43. The conveying mechanism 40 includes, along the conveying path K, a paper sensor 44 configured to detect presence or absence of the check P.

The magnetic-ink reading device 50 includes a magnetizing mechanism 60 configured to magnetize the magnetic ink of the check P on the conveying path K and a MICR head (magnetism detection head) 70 disposed near a conveying direction downstream side in the conveying path K of the magnetizing mechanism 60 and configured to read magnetism of the magnetized magnetic ink.

The magnetizing mechanism 60 includes a magnet 61 magnetized on the surface of the check P conveyed along the conveying path K.

The MICR head 70 detects residual magnetism of MICR characters. The MICR characters are read as a magnetic characteristic and a magnetic pattern and output to the control section 20 as an electric signal. The magnetic characteristic and the magnetic pattern of the MICR characters are registered in the control section 20 in advance. The MICR characters are identified by being collated with the magnetic characteristic and the magnetic pattern.

The printing mechanism 90 includes an inkjet head 91 configured to perform printing instructed from the control section 20.

As illustrated in FIG. 3, the reversing mechanism 100 includes a rectangular parallelepiped housing 110. The housing 110 includes a reversing path H located on the left side in FIG. 3 and a retraction path T located on the right side in FIG. 3. An opening section 111 is formed in a lower part of the housing 110 and disposed to be opposed to the conveying path K. The reversing mechanism 100 includes, on the MICR head 70 side of the opening section 111, a reversal introduction port 112 for introducing the check P into the reversing path H and includes, on the medium inlet and outlet port 12 side, a retraction introduction port 113 for introducing the check P into the retraction path T.

A pair of rollers 121 and 122 are provided in the housing 110. An endless belt 123 is laid over the pair of rollers 121 and 122. The roller 121 is driven by a driving motor. The driving is controlled by the control section 20. Paths (the reversing path H and the retraction path T), through which the check P can pass, are formed between the surface of the endless belt 123 and the inner wall of the housing 110.

As illustrated in FIG. 4, a switching flapper 130 is disposed in the opening section 111 of the housing 110. The switching flapper 130 includes a first flapper 131 located on the left side in FIG. 4 and a second flapper 132 located on the right side in FIG. 4. The first flapper 131 and the second flapper 132 are controlled by the control section 20 independently from each other. Both of the first flapper 131 and the second flapper 132 are set to be selectively movable between upper positions and lower positions. In the upper positions, both of the first flapper 131 and the second flapper 132 are held by a weak urging force that allows the flappers to move to the lower positions if the check P is placed on the flappers.

If the check P moves in the right direction in FIG. 3, the switching flapper 130 switches delivery to the reversal introduction port 112 side, the retraction introduction port 113 side, and the medium inlet and outlet port 12 side. That is, the check P is delivered to the reversal introduction port 112 if the first flapper 131 is in the lower position, delivered to the retraction introduction port 113 if the first flapper 131 is in the upper position and the second flapper 132 is in the lower position, and delivered to the medium inlet and outlet port 12 if both of the first flapper 131 and the second flapper 132 are in the lower positions.

Figure 5:
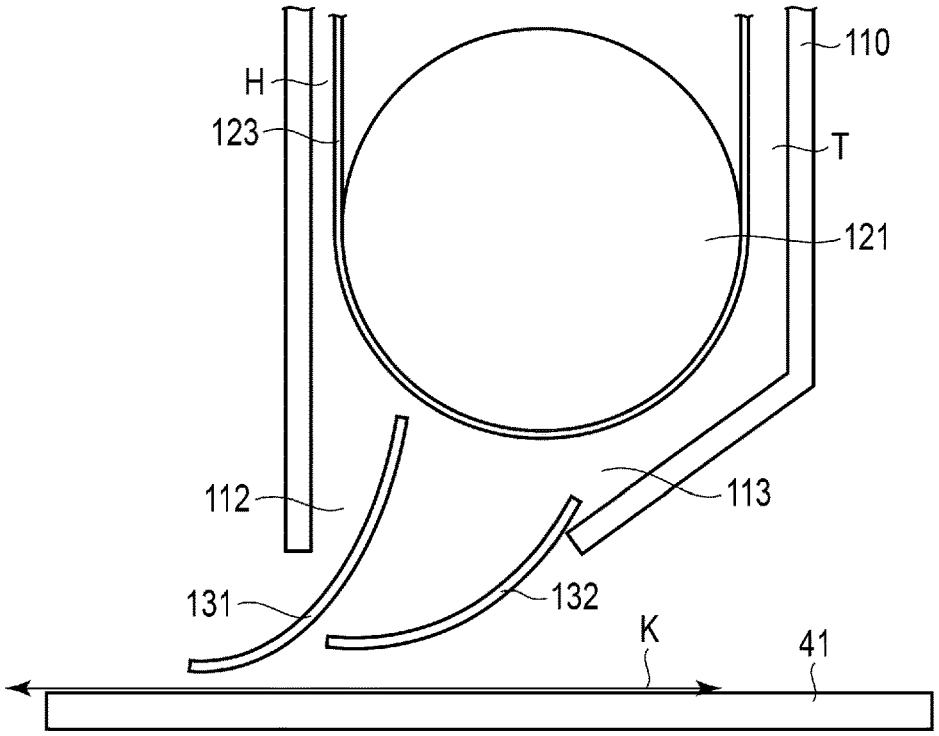
FIG. 5 is an explanatory diagram illustrating a relation between the reversing mechanism and a switching flapper during standby.
Figure 6:
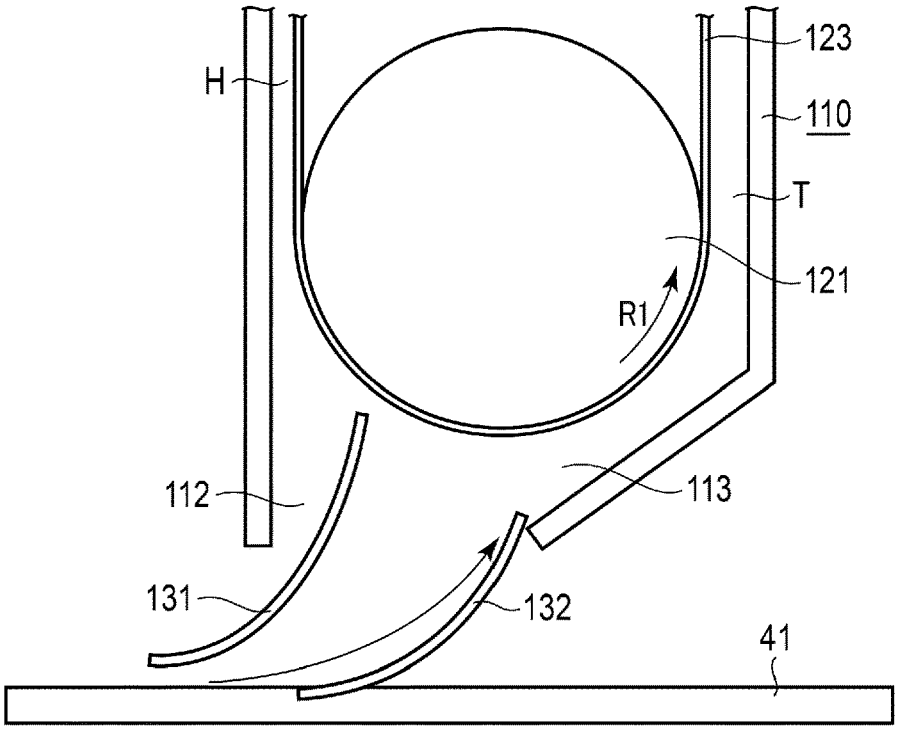
FIG. 6 is an explanatory diagram illustrating a relation between the reversing mechanism and the switching flapper during check retraction.
Figure 7:
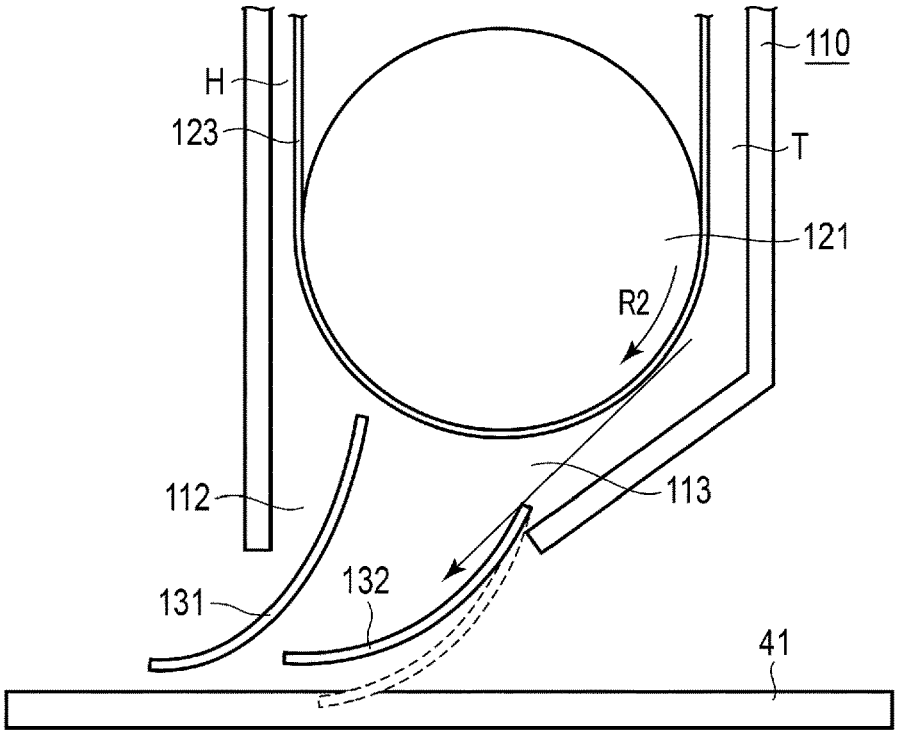
FIG. 7 is an explanatory diagram illustrating a relation between the reversing mechanism and the switching flapper during check discharge.
Figure 8:
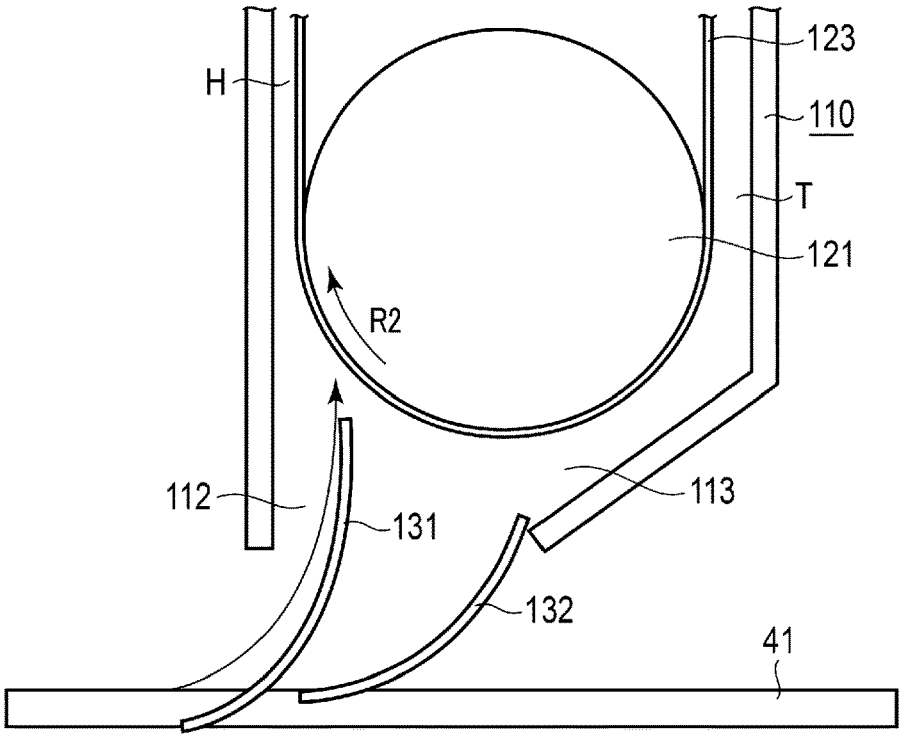
FIG. 8 is an explanatory diagram illustrating a relation between the reversing mechanism and the switching flapper at a check reversal start time.

The printer 10 configured as explained above performs magnetic ink reading and printing on the check P as explained below. Note that FIG. 5 is an explanatory diagram illustrating a relation between the reversing mechanism 100 and the switching flapper 130 during retraction. FIG. 6 is an explanatory diagram illustrating a relation between the reversing mechanism 100 and the switching flapper 130 during check retraction. FIG. 7 is an explanatory diagram illustrating a relation between the reversing mechanism 100 and the switching flapper 130 during check discharge. FIG. 8 is an explanatory diagram illustrating a relation between the reversing mechanism 100 and the switching flapper 130 at a check reversal start time.

If the check P is inserted or discharged, if reversal is not performed, or if retraction is not performed, as illustrated in FIG. 5, both of the first flapper 131 and the second flapper 132 are in the upper positions.

The check P is inserted by a user from the medium inlet and outlet port 12 of the housing 11 with the surface printed with the MICR characters directed downward. The inserted check P is conveyed by the conveying mechanism 40 toward the left direction in FIG. 5 along the conveying path K.

If the check P reaches the magnetizing mechanism 60, the MICR characters pass through the magnetizing mechanism 60. At this time, the MICR characters are magnetized by the magnetism of the magnet 61. The conveyance by the conveying mechanism 40 is once stopped in the paper sensor 44 at a point in time when the check P reaches the left end in FIG. 2 of the conveying path K.

Subsequently, as illustrated in FIG. 6, the second flapper 132 moves to the lower position. The pair of rollers 121 and 122 of the reversing mechanism 100 is rotated in an arrow R1 direction in FIG. 6. If the check P is conveyed in the right direction in FIG. 6 by the conveying mechanism 40 and the MICR characters reach the MICR head 70, a residual magnetic field generated by residual magnetism of the MICR characters is detected by the MICR head 70. The MICR characters are identified by the control section 20 from the magnetic characteristic and the magnetic pattern of the residual magnetism. At the same time, the check P is introduced into the retraction path T of the reversing mechanism 100 from the retraction introduction port 113 by the second flapper 132 and the endless belt 123.

Subsequently, if printing is performed on the check P, as illustrated in FIG. 7, the pair of rollers 121 and 122 of the reversing mechanism 100 is rotated in an arrow R2 direction in FIG. 7 to discharge the check P in the retraction path T onto the conveying path K from the reversing mechanism 100.

The check P on the conveying path K is conveyed toward the left side in FIG. 2 by the conveying mechanism 40. The conveyance by the conveying mechanism 40 is once stopped in the paper sensor 44 at a point in time when the check P reaches the left end in FIG. 2 of the conveying path K. Subsequently, printing is performed by the inkjet head 91 of the printing mechanism 90 while the check P is conveyed toward the right direction in FIG. 2. At this time, as illustrated in FIG. 6, the second flapper 132 is moved to the lower position to prevent the check P from being conveyed to the medium inlet and outlet port 12 side. The pair of rollers 121 and 122 are rotated in the arrow R1 direction in FIG. 6 to introduce the check P into the retraction path T of the reversing mechanism 100.

After the printing is completed, as illustrated in FIG. 7, the reversing mechanism 100 reversely rotates the pair of rollers 121 and 122 to return the check P onto the conveying path K. After the check P is moved in the left direction in FIG. 2 by the conveying mechanism 40, the first flapper 131 and the second flapper 132 are moved to the upper positions to discharge the check P to the outside of the apparatus from the medium inlet and outlet port 12. In this way, the reading and the printing of the check P are completed. The check P is discharged from the medium inlet and outlet port 12 by the conveying mechanism 40.

Subsequently, the check P is reversed to perform reading and printing on the rear surface of the check P. After the reading and the printing of the check P are completed as explained above, as illustrated in FIG. 8, the first flapper 131 is moved to the lower position and the check P is introduced into the reversing path H of the reversing mechanism 100 from the reversal introduction port 112 while the check P is conveyed toward the right direction in FIG. 2 along the conveying path K by the conveying mechanism 40. The reversing mechanism 100 rotates the pair of rollers 121 and 122 in the arrow R2 direction in FIG. 8 and conveys the check P with the endless belt 123. The reversing mechanism 100 moves the check P from the reversing path H side to the retraction path T side in the housing 110 with the endless belt 123. The revering mechanism 100 further rotates the pair of rollers 121 and 122, conveys the check P with the endless belt 123, and discharges the check P from the retraction introduction port 113 of the housing 110. As illustrated in FIG. 7, the discharged check P is guided on the upper surface of the second flapper 132. At this time, the second flapper 132 is moved to the lower position by a conveying force of the check P. The check P is returned to the conveying path K. In this way, the reversal of the check P is completed. Thereafter, reading, printing, and discharge are performed as explained above.

In this way, with the printer 10 according to this embodiment, the check P can be temporarily retracted using the reversing mechanism 100 set in general. Therefore, if magnetic ink printed on a medium is read and processed, it is unnecessary to add a new retraction path in order to prevent the medium from being pulled out by the user by mistake. The apparatus can be simplified and reduced in size. If processing such as reading and printing is performed on the check P, the check P is introduced into the retraction path T from the retraction introduction port 113 located on a far side from the MICR head 70 and the printing mechanism 90. Therefore, an unnatural bending force and a strong tensile force are not applied to the check P. A deficiency such as a reading error or a printing error does not occur during retraction of the check P. On the other hand, if the check P is reversed, since the processing such as reading and printing is not performed, the reversal introduction port 112 on a side close from the MICR head 70 and the printing mechanism 90 can be used. Therefore, the distance from the MICR head 70 and the printing mechanism 90 to the reversing mechanism 100 can be reduced. The entire apparatus can be reduced in size.

In at least one embodiment explained above, the retraction path T is used as a place to which the check P is temporarily retracted. However, if the check P is thin and has sufficient flexibility, the check P may be retracted to the reversing path H side. Timings of magnetization, reading, printing, retraction, and reversal are not limited to the timings explained above and can be changed as appropriate according to a processing method required for the check P. Further, the magnetic-ink reading device may be used for a sheet-like medium other than the check P.

At least one embodiment is explained above. However, the at least one embodiment is presented as an example and is not intended to limit the scope of the invention. Other embodiments can be implemented in other various forms. Various omissions, substitutions, and changes can be performed without departing from the spirit of the invention. The embodiments and modifications of the embodiments are included in the scope and the gist of the invention and included in the inventions described in claims and the scope of equivalents of the inventions.

What is claimed is:

1. A magnetic-ink reading device comprising:

a housing having a medium inlet and outlet port for inserting and pulling out a sheet-like medium printed using magnetic ink;

a conveyor provided in the housing and configured to convey the medium along a conveying path;

a magnetizing mechanism configured to magnetize the magnetic ink of the medium on the conveying path;

a magnetism detection head disposed by the magnetizing mechanism along the conveying path and configured to read magnetism of the magnetized magnetic ink; and a reversing mechanism configured to introduce the medium conveyed toward a medium inlet and outlet port side along the conveying path, reverse front and rear surfaces of the medium on a reversing path on an inside, and discharge the medium onto the conveying path toward the magnetic detection head, wherein the reversing mechanism includes a retraction path configured to temporarily retract the medium when the magnetism of the medium conveyed toward the medium inlet and outlet port side along the conveying path is read by the magnetism detection head.

2. The device according to claim 1, wherein the reversing mechanism includes, on the magnetism detection head side, a reversal introduction port arranged to introduce the medium into the reversing path, including, on the medium inlet and outlet port side, a retraction introduction port arranged to introduce the medium into the retraction path, and including a switching flapper provided on the conveying path and configured to switch delivery to the reversal introduction port side, the retraction introduction port side, and the medium inlet and outlet port side.

3. The device according to claim 2, wherein the switching flapper includes a first flapper and a second flapper.

4. The device according to claim 3, wherein when the first flapper is in a lower position, the switching flapper is configured to provide delivery to the reversal introduction port.

5. The device according to claim 3, wherein when the first flapper is in an upper position and the second flapper is in a lower position, the switching flapper is configured to provide delivery to the retraction introduction port.

6. The device according to claim 3, wherein when the first flapper is in an lower position and the second flapper is in a lower position, the switching flapper is configured to provide delivery to the medium inlet and outlet port.

7. The device according to claim 2, wherein the switching flapper is configured to perform an operation for delivering the medium to the retraction introduction port when magnetism of the medium is read by the magnetism detection head.

8. The device according to claim 1, wherein the conveyor includes conveying rollers arranged to convey the medium.

9. The device according to claim 1, wherein the reversing mechanism includes conveying rollers and an endless belt arranged to convey the medium.

10. A printer comprising:

the magnetic-ink reading device according to claim 1;

a controller configured to generate printing information on the basis of information based on magnetism detected by the magnetism detection head; and a print head configured to print the printing information on the medium.

11. The printer according to claim 10, wherein the revering mechanism includes, on the magnetism detection head side, a reversal introduction port arranged to introduce the medium into the reversing path, including, on the medium inlet and outlet port side, a retraction introduction port arranged to introduce the medium into the retraction path, and including a switching flapper provided on the conveying path and configured to switch delivery to the reversal introduction port side, the retraction introduction port side, and the medium inlet and outlet port side, and the switching flapper is configured to perform an operation for delivering the medium to the retraction introduction port when the printing information is printed on the medium.

12. The printer according to claim 11, wherein the switching flapper includes a first flapper and a second flapper.

13. The printer according to claim 12, wherein when the first flapper is in a lower position, the switching flapper is configured to provide delivery to the reversal introduction port.

14. The printer according to claim 12, wherein when the first flapper is in an upper position and the second flapper is in a lower position, the switching flapper is configured to provide delivery to the retraction introduction port.

15. The printer according to claim 12, wherein when the first flapper is in an lower position and the second flapper is in a lower position, the switching flapper is configured to provide delivery to the medium inlet and outlet port.

16. The printer according to claim 11, wherein the switching flapper is configured to perform an operation for delivering the medium to the retraction introduction port when magnetism of the medium is read by the magnetism detection head.

17. The printer according to claim 10, wherein the conveyor includes conveying rollers arranged to convey the medium.

18. The printer according to claim 10, wherein the reversing mechanism includes conveying rollers and an endless belt arranged to convey the medium.

19. A method of operating a magnetic-ink reading device including a housing having a medium inlet and outlet port for inserting and pulling out a sheet-like medium printed using magnetic ink, the method comprising:

conveying the medium along a conveying path;

magnetizing, via a magnetizing mechanism, the magnetic ink of the medium on the conveying path;

reading magnetism of the magnetized magnetic ink near the magnetizing mechanism along the conveying path;

introducing the medium conveyed toward a medium inlet and outlet port side along the conveying path;

reversing front and rear surfaces of the medium on a reversing path on an inside;

discharging the medium onto the conveying path toward the magnetic detection head side; and temporarily retracting the medium when the magnetism of the medium is read by the magnetism detection head in a retraction path.

* * * * *